US012180669B2

(12) United States Patent
Vankeirsbilck et al.

(10) Patent No.: US 12,180,669 B2
(45) Date of Patent: Dec. 31, 2024

(54) SOIL-DISPLACEMENT DRILL AND METHOD FOR FORMING A SMOOTH FOUNDATION PILE WITH SUCH A SOIL-DISPLACEMENT DRILL

(71) Applicant: Olivier Industrie NV, Rumbeke (BE)

(72) Inventors: Gerdi Vankeirsbilck, Rumbeke (BE); Dimitry Vankeirsbilck, Rumbeke (BE)

(73) Assignee: Olivier Industrie NV, Rumbeke (BE)

( * ) Notice: Subject to any disclaimer, the term of this patent is extended or adjusted under 35 U.S.C. 154(b) by 107 days.

(21) Appl. No.: 17/790,084

(22) PCT Filed: Jan. 18, 2021

(86) PCT No.: PCT/IB2021/050342

§ 371 (c)(1),
(2) Date: Jun. 29, 2022

(87) PCT Pub. No.: WO2021/144773

PCT Pub. Date: Jul. 22, 2021

(65) Prior Publication Data

US 2023/0040291 A1 Feb. 9, 2023

(30) Foreign Application Priority Data

Jan. 16, 2020 (BE) ..... 2020/5033

(51) Int. Cl.
*E02D 5/36* (2006.01)

(52) U.S. Cl.
CPC ..... *E02D 5/36* (2013.01); *E02D 2250/0023* (2013.01); *E02D 2250/0038* (2013.01); *E02D 2300/002* (2013.01)

(58) Field of Classification Search
CPC ..... E02D 5/36; E02D 2250/0023; E02D 2250/0038; E02D 2300/002
See application file for complete search history.

(56) References Cited

U.S. PATENT DOCUMENTS 5,219,246 A * 6/1993 Coutts ..... E02D 5/44 175/292
5,722,498 A * 3/1998 Van Impe ..... E02D 5/36 175/394

(Continued)

FOREIGN PATENT DOCUMENTS

EP 1580323 A1 9/2005
NL 8802944 A * 6/1990 ..... E02D 5/385

(Continued)

OTHER PUBLICATIONS

International Search Report and Written Opinion for PCT/IB2021/050342 , mailing date of Apr. 21, 2021.

*Primary Examiner* — Kyle Armstrong

(74) *Attorney, Agent, or Firm* — FRESH IP PLC; Clifford D. Hyra; Aubrey Y. Chen

(57) ABSTRACT

The present disclosure relates to a soil displacement drill comprising a drill pipe; a widening at one end of the drill pipe that is provided with (1) a screw blade for screwing the drill into the substrate, and (2) an outlet opening for the passage of material that is introduced for forming the foundation pile; and a flap that is movable between a first position for allowing unhindered screwing of the drill into the substrate and a second position for preventing the material from entering a screw groove. The screw groove is formed in the substrate by the screw blade during unscrewing of the drill from the substrate. The disclosure further relates to a method for forming a smooth foundation pile using such a drill.

10 Claims, 6 Drawing Sheets

(56) References Cited

U.S. PATENT DOCUMENTS

| | | | | |
|---|---|---|---|---|
| 6,033,152 | A * | 3/2000 | Blum | E21B 7/265 405/242 |
| 2012/0087740 | A1 * | 4/2012 | Stroyer | E02D 11/00 405/241 |
| 2022/0136199 | A1 * | 5/2022 | Mcmillan | E02D 5/46 405/248 |

FOREIGN PATENT DOCUMENTS

| | | | |
|---|---|---|---|
| NL | 9000498 | A | 10/1991 |
| WO | WO 0022244 | A1 | 4/2000 |

* cited by examiner

SOIL-DISPLACEMENT DRILL AND METHOD FOR FORMING A SMOOTH FOUNDATION PILE WITH SUCH A SOIL-DISPLACEMENT DRILL

FIELD OF THE DISCLOSURE

The present disclosure concerns a soil-displacement drill for soil-displacing drilling into a substrate for forming a foundation pile.

The present disclosure also concerns a method for forming a foundation pile with such a soil-displacement drill.

BACKGROUND

There are two types of foundation pile which are formed using such soil-displacement drills. The type of foundation pile used depends on the soil. Screw-shaped foundation piles are usually formed in clay soil, while smooth foundation piles are formed in hard sand layers.

In order to form these foundation piles, different types of such soil-displacement drills are used.

In order to form screw-shaped foundation piles, drills are used in which the drill pipe is provided at the base with a widening, wherein this widening is provided with a screw blade. These widenings displace the soil directly below the drill so that no soil is brought above ground. Examples of such drills are described and shown for example in EP 0 747 537 A1 and WO 2019/077416 A1.

Smooth foundation piles are formed in practice with drills in which the drill pipe is provided with a screw blade at one end and a displacer at a certain distance from this end above the screw blade. The screw blade below the drill pipe is designed to pull the drill into the soil in order to be able to form a pile and transport the soil to the displacer so that the displacer may displace this soil laterally.

Such a drill is described and shown for example in EP 0 228 138 A2.

These soil-displacement drills transport the soil firstly by means of the screw blade as far as the displacer so that the soil can be displaced laterally by the displacer.

At the level of the lowest part of the formed pile, the soil is not therefore displaced so that in some cases a relaxation of the soil can occur, leading to more settling of the pile.

A great deal of friction occurs because the screw blade transports the soil up to the displacer while the drill is being screwed in. This friction ensures greater wear, heating of the drill and greater energy consumption. More wear entails extra costs because the drill must be built up more. Heating of the drill may for example lead to blockages of concrete which must pass through the drill in order to form the foundation pile. More energy consumption means extra costs and environmental load.

When unscrewing the drill, the pitch does not remain constant, so necking in the pile cannot be excluded.

In practice, the displacer cannot displace the soil completely laterally. When the drill is retracted after drilling a pile, some of the soil remains between the screw blades below the displacer. This soil is brought above ground with the drill. This soil must then be scraped off, loaded and discharged, which is time-consuming, costly and environmentally harmful.

These drills for forming smooth foundation piles are also much costlier in production than drills for forming screw-shaped foundation piles.

SUMMARY

The object of at least one embodiment of this disclosure is to provide a soil-displacement drill with which smooth foundation piles can be formed, without said disadvantages of the known soil-displacement drills for forming smooth foundation piles.

This object is achieved by the provision of a soil-displacement drill for soil-displacing drilling into a substrate in order to form a foundation pile, comprising:

- a drill pipe with a pipe casing with a first outer diameter; and
- a widening which is configured as a displacer and for this:
  - has an outer casing with a second outer diameter which is greater than the first outer diameter of the drill pipe;
  - is provided at one end of the drill pipe, and has an end remote from this drill pipe; and which furthermore
  - is provided with a screw blade which protrudes relative to the outer casing for screwing the drill into the substrate, and has an end which is arranged at said end of the widening; and
  - is provided with an outlet opening for the passage of material that is introduced into the drill pipe for forming the foundation pile;

wherein the drill has a flap which is arranged below the widening and is movable between:

- a first position in which the flap is arranged in a zone, the zone being outside an imaginary extension of the screw blade and below the widening; and
- a second position in which said flap is arranged below the widening with an area which is at least as large as the greatest transverse cross-section of the screw blade, between the outlet opening and said end of the screw blade.

By providing this flap, a soil-displacement drill according to at least one embodiment this disclosure offers the same advantages for forming smooth piles as in soil-displacement drills for forming screw-shaped piles.

When screwing in such a drill (in the direction of the screw blade), the flap may be brought to the first position or it may be ensured that the flap is automatically in this position. In this position, the flap is arranged such that the flap allows the drill to screw unhindered into the substrate. Soil is then displaced laterally at the level of the widening, just as in known drills with a widening, so that no soil is brought above ground. Soil is also displaced to below the formed pile.

Less friction occurs when screwing in the widening.

When unscrewing the drill (against the direction of the screw blade), the flap may be brought into the second position or it may be ensured that the flap is automatically in this position. In this second position, the flap is arranged between the outlet opening and said end of the screw blade. The flap blocks this outlet opening here with an area which is at least as large as the greatest cross-section of the screw blade. Thus the flap is arranged between the groove (screw slot) produced in the substrate and the outlet opening of the drill, over an area which is at least as large as the cross-section of the resulting groove. Thus the flap acts as a smoothing blade between the outlet opening and the screw blade on the side of the displaced soil. This ensures that the soil is smoothed out. The second edge of the flap at the same time prevents said material, when the drill is unscrewed from the substrate, from entering the screw slot formed in the substrate by the screw blade, so that the resulting slot is smoothed out by the flap acting as a smoothing blade.

When the flap is brought into its second position, material for forming the foundation pile, such as e.g. concrete, is thus prevented from filling the screw slot formed by the screw blade in the soil. The screw slot is in fact pushed back in sealed fashion on withdrawal of the drill when the flap is brought into its second position.

On unscrewing, if necessary a constant pitch can be maintained, whereby necking in the pile can be avoided and an even better result obtained.

Because the widening is arranged at the end of the drill pipe and provided from the outlet opening, and the screw blade protrudes with respect to the outer casing of this widening, then in contrast to the prior art, spirals need no longer be arranged between the lower edge of the drill and such a widening, so that the drill can be designed shorter. The widening may be made relatively shorter in order to displace the soil. In this way, the friction is limited and less force is required to move the drill into and out of the soil.

To prevent soil from entering the drill pipe through the outlet opening when the drill is screwed into the substrate, at the end of the widening either a single-use drill tip may be provided for closing this outlet opening, or one or more closing flaps may be provided which close off the outlet opening on screwing in and open the outlet opening again on unscrewing of the drill from the substrate.

The drill pipe preferably has a substantially circular cross-section. The outer casing is preferably completely cylindrical.

The drill pipe may be provided with spirals on its outside and/or inside.

The drill pipe may be made of one piece or several pieces.

In a drill according to at least one embodiment of this disclosure, preferably no displacer is now arranged at a certain distance from the end of the drill pipe above the screw blade.

The widening also preferably has a substantially circular cross-section, and the outer casing thereof is preferably cylindrical. Preferably, the maximum diameter of the widening is situated at the height of the screw blade, and is greater than the diameter of the drill pipe above this widening. The widening preferably comprises the same outer diameter throughout. In the case of larger diameters, the widening for example may taper slightly conically towards the pipe casing at the top. The widening may also be slightly conical at the bottom.

The screw blade protrudes relative to the outer casing of the widening so that this has an outer diameter which is even greater than said second outer diameter of the widening. The screw blade preferably has the same outer diameter throughout.

The cavity through the drill pipe and the widening for allowing passage of material, which is introduced into the drill pipe for forming the foundation pile, is preferably sufficiently large for introduction of full reinforcement. Thus the reinforcement may also be applied directly and need not be positioned subsequently.

The drill pipe and the widening are preferably made of steel.

The flap is also preferably made of steel.

Said flap below the widening is preferably pivotably attached to the widening.

The flap is here preferably positioned such that, in unhindered state when the drill is erected with the widening below the drill pipe, said flap hangs down in its second position. In this way, the flap can simply be brought into and held in its second position when the drill is unscrewed from the substrate.

The flap may also be forced into and held in its second position by the pressure of the material which is introduced through the drill pipe for forming the foundation pile.

Furthermore, this flap is preferably positioned such that, when the drill is screwed into a substrate, said flap is held in its first position by the substrate. Then no further aids are required for holding such a flap in its first position while the drill is screwed into the substrate.

To provide the pivoting of the flap, for example one or more hinge bodies may be provided on the widening, and one or more corresponding hinge bodies may be provided on the flap, and a hinge shaft may pass through these hinge bodies to ensure that the assembly is held together and hinged.

The screw blade of a drill according to at least one embodiment of this disclosure preferably has a maximum thickness which is between 15 mm and 100 mm. Even more preferably, this maximum thickness is less than 70 mm, and extremely preferably less than or equal to 30 mm.

The screw blade is furthermore preferably configured with a right-hand thread.

In a specific embodiment, the widening of the drill according to at least one embodiment of this disclosure may be provided with at least one second screw blade which protrudes relative to the outer casing for screwing the drill into the substrate, and has an end which is arranged at said end of the widening. Such a drill is provided with at least one second flap which is arranged below the widening and is movable between:

- a first position in which this second flap is arranged in a zone, the zone being outside an imaginary extension of the second screw blade and below the widening, so that this second flap allows the unhindered screwing of the drill into the substrate; and
- a second position in which said second flap is arranged below the widening with an area of the flap which is at least as large as the greatest transverse cross-section of the second screw blade, between the outlet opening and said end of the second screw blade, so that this second flap prevents said material from entering the screw slot, formed in the substrate by the second screw blade, when the drill is unscrewed from the substrate.

The second screw blade is here twisted preferably through 180° with respect to the first screw blade.

The number of screw blades is preferably limited to a maximum of two screw blades. The screw blades are here preferably arranged at the same height with their said end at said end of the widening. The more screw blades are provided, the less space remains between the screw blades. The pitch of the screw blades may then be increased, but a higher pitch with several screw blades makes the construction of such a drill unnecessarily complex and costly.

Preferably, a drill according to at least one embodiment of the disclosure only has one said screw blade.

The object of at least one embodiment of this disclosure is furthermore achieved by the provision of a method for forming a smooth foundation pile by means of a soil-displacement drill as described above according to this disclosure, wherein:

- the drill is screwed into the substrate while the flap remains in its first position;
- material for forming the foundation pile is introduced into the drill pipe; and
- the drill is withdrawn from the substrate while the flap remains in its second position.

As material for forming the foundation pile, here for example concrete may be introduced into the drill pipe. In some cases, reinforcement may also be introduced into the drill pipe before this material is introduced into the drill pipe.

The slot, which is produced by the screw blade and smoothed out by the flap acting as a smoothing blade, normally has a thickness equal to the thickness of the screw blade when the screw blade maintains the same pitch.

In a preferred embodiment of the method according to this disclosure, on withdrawal of the drill from the substrate, the drill is unscrewed from the substrate with a pitch which is smaller than the pitch of the screw blade. If a smaller pitch than the pitch of the screw blade is used, the thickness of the slot to be smoothed out becomes smaller with the difference in pitch. Finer slots can more easily be smoothed tightly with a flap of a drill according to at least one embodiment of this disclosure. With wider slots too, a flap of a drill according to at least one embodiment of this disclosure can ensure the at least partial smoothing of this slot, so that a smoother pile is obtained then if no such flap is present. The combination with a smaller pitch simply ensures an even better result.

The smaller pitch ensures that the screw blade helps to reclose the screw slot, which is formed when the drill is screwed into the substrate, when the drill is unscrewed, without material for forming the foundation pile entering the screw slot.

Embodiments of the disclosure are now explained in more detail with reference to the following more detailed description of some preferred soil-displacement drills according to this disclosure. The aim of this description is exclusively to give clarifying examples and indicate further advantages and features of embodiments of this disclosure, and thus it may be in no way be interpreted as a restriction of the area of application of embodiments of the disclosure or of the patent rights claimed in the claims.

BRIEF DESCRIPTION OF THE FIGURES

In this description, by means of reference signs, reference is made to the appended drawings in which.

DETAILED DESCRIPTION

Figure 1:
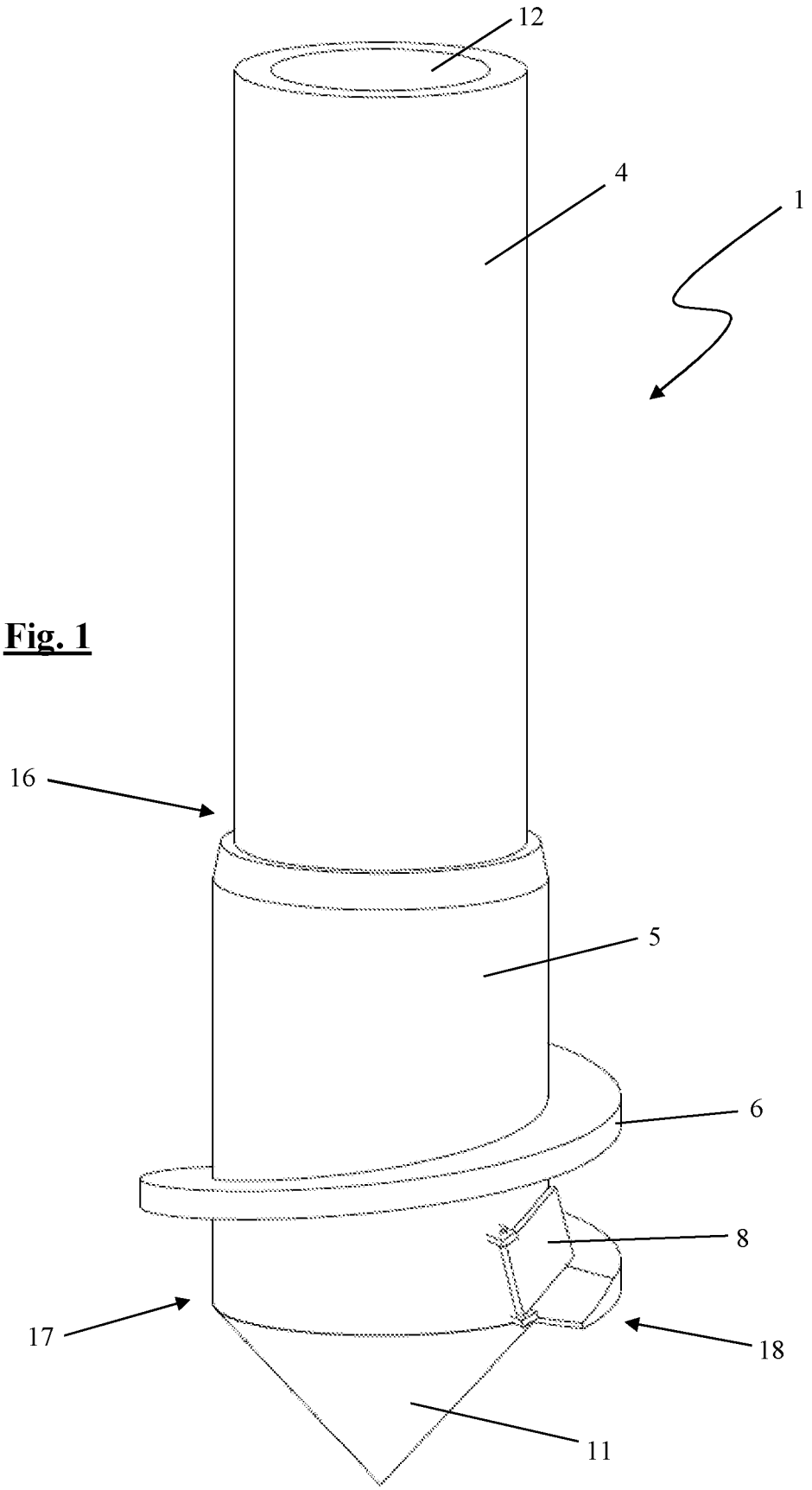
FIG. 1 shows an embodiment of a soil-displacement drill according to at least one embodiment of this disclosure in perspective, with a single-use drill tip and with the flap in its first position.
Figure 2:
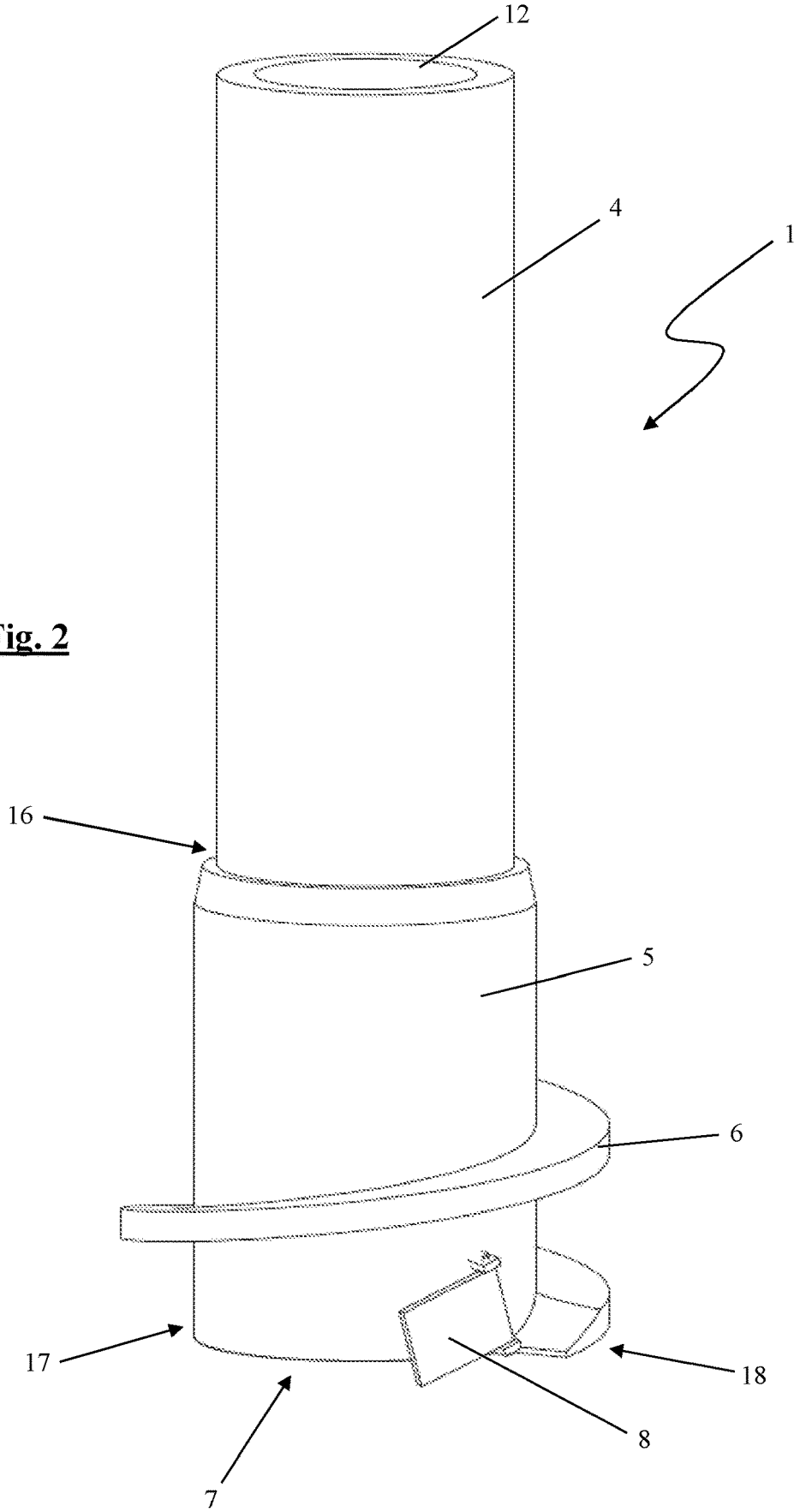
FIG. 2 shows the drill from FIG. 1 in perspective, without the single-use drill tip and with the flap in its second position.

The soil-displacement drills (1) shown each comprise a drill pipe (4), a widening (5) and a flap (8).

The drill pipe (4) is in each case configured so as to be substantially cylindrical and is provided with a widening (5) at the bottom at one end (16). A screw blade (6), which protrudes with respect to the outer casing of the widening (5), is arranged on said widening (5). In the embodiments shown, the screw blade (6) is in each case arranged on the bottom half of the widening (5). One end (18) of the screw blade (6) is arranged at an end (17) of the widening (5) which is remote from the drill pipe (4). In the second embodiment illustrated, the drill (1) is provided with a second screw blade (14) which is arranged on the widening (5), twisted through 180° relative to the first screw blade (6). This second screw blade (14) is furthermore identical to the first screw blade (6) and is also arranged with one end (19) on said end (17) of the widening (5).

The maximum outer diameter ($D_2$) of the outer casing of the widening (5) is situated at the height of the screw blade (6) and is greater than the outer diameter ($D_1$) of the outer casing of the drill pipe (4) above this widening (5). The screw blade (6) has a constant outer diameter ($D_3$) which is greater than the outer diameter ($D_2$) of the outer casing of the widening (5).

The screw blade (6) has a maximum thickness (d) which is between 50 mm and 100 mm. Even more preferably, said maximum thickness (d) is less than 70 mm, and extremely preferably less than or equal to 30 mm.

A cylindrical cavity (12) extends through the entire drill pipe (4) and opens below the widening (5) into an outlet opening (7) for the passage of material (9) which is introduced into the cylindrical cavity (12) for forming a foundation pile (3).

In some cases, the drill pipe (4) may be provided with one or more secondary spirals (screw blades) on the inside or outside.

The drill pipe (4), the widening (5) and the screw blade (6) may for example be made of metal, for example steel. The screw blade (6) may be attached to the widening (5) by welding.

In the first embodiment depicted, a single-use drill tip (11) is provided at the bottom end (17) of the widening (5).

This single-use drill tip (11) is not attached to the widening (5) but is arranged thereon so that the drill (1) can bore into the substrate (2) and at that moment is held against the widening (5) by the substrate (2).

This single-use drill tip (11) may also be made of metal.

As an alternative to this single-use drill tip (11), the soil-displacement drill (1) may also be provided with one or more closing flaps which are pivotably attached to the bottom of the widening (5) for closing the outlet opening (7).

At the level of each screw blade (6, 14) and next to said end (18, 19) of the screw blade (6, 14), a corresponding flap (8, 15) is pivotably attached to the widening (5) at the bottom of the widening (5).

Figure 3:
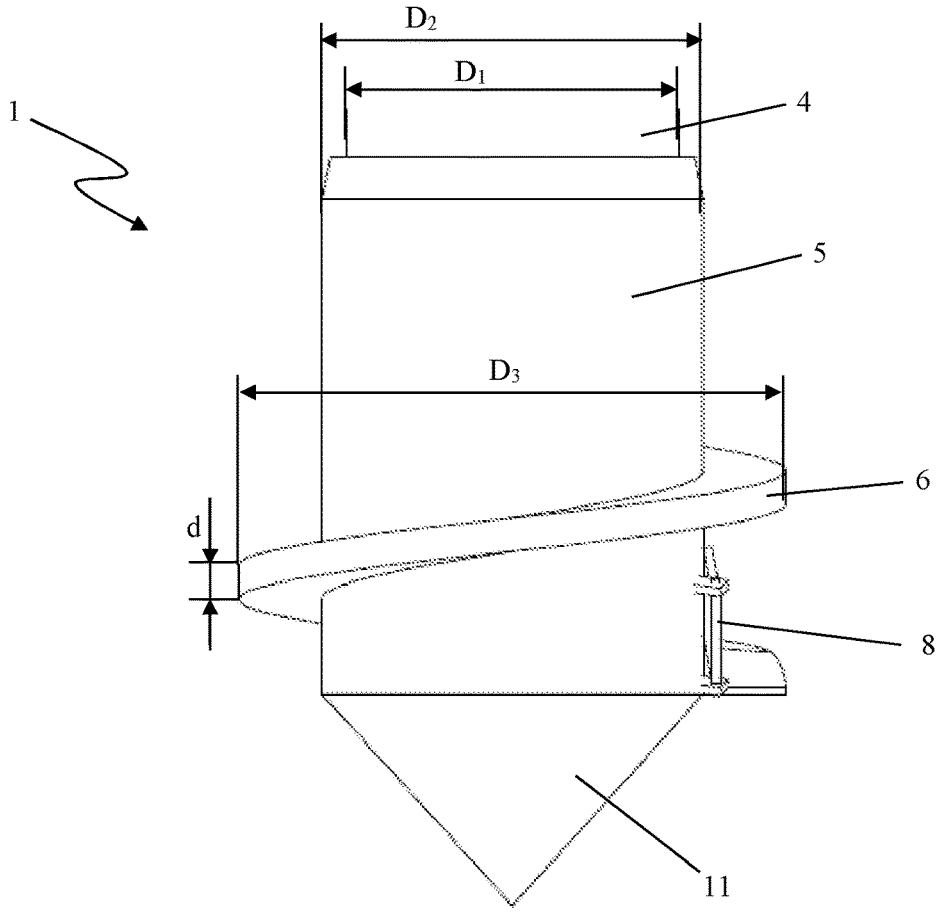
FIG. 3 shows the drill from FIG. 1 in a front view, with single-use drill tip and with the flap in its first position.
Figure 4:
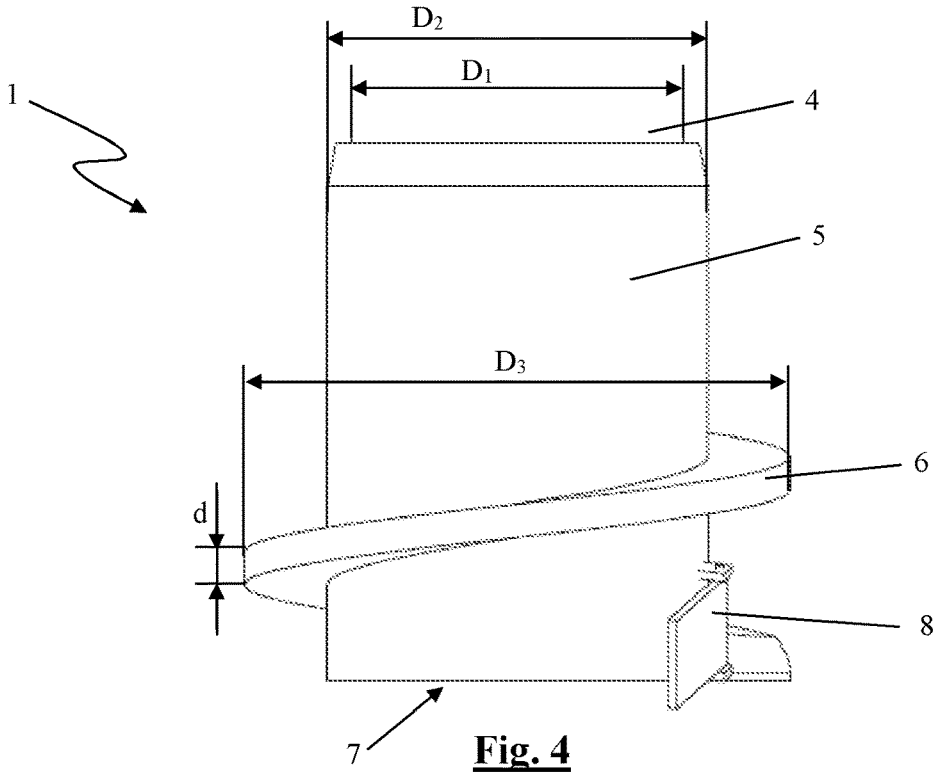
FIG. 4 shows the drill from FIG. 1 in perspective, without the single-use drill tip and with the flap in its second position.

This flap (8, 15) is moveable between:

- a first position as shown in FIGS. 1 and 3, in which this flap (8, 15) is arranged such that it allows the unhindered screwing of the drill (1) into the substrate (2); and
- a second position as shown in FIGS. 2, 4, 6 and 7, in which this flap (8, 15) is arranged below the widening (5) with an area which is at least as large as the greatest cross-section of the corresponding screw blade (6, 15), between the outlet opening (7) and said end (18, 19) of the corresponding screw blade (6, 14), such that this flap (8, 15) prevents the material (9) that is introduced into the cylindrical cavity (12) from entering the screw slot, which was formed in the substrate by the screw blade (6, 14), when the drill (1) is unscrewed from the substrate (2).

In order to allow the unhindered screwing of the drill (1) into the substrate (2) in the first position, each flap (8, 15) is arranged in a zone, the zone being outside an imaginary extension of the corresponding screw blade (6, 14). In the first and second embodiments illustrated, said flap (8) is arranged against the casing of the widening (5). Alternatively but less preferably, for this for example the flap (8) may also rest against the outer surface of the single-use tip (11), as in the third embodiment illustrated. As another alternative, the flap (8) could for example be designed as a shut-off valve for closing the outlet opening (7) in the widening (5).

Figure 5:
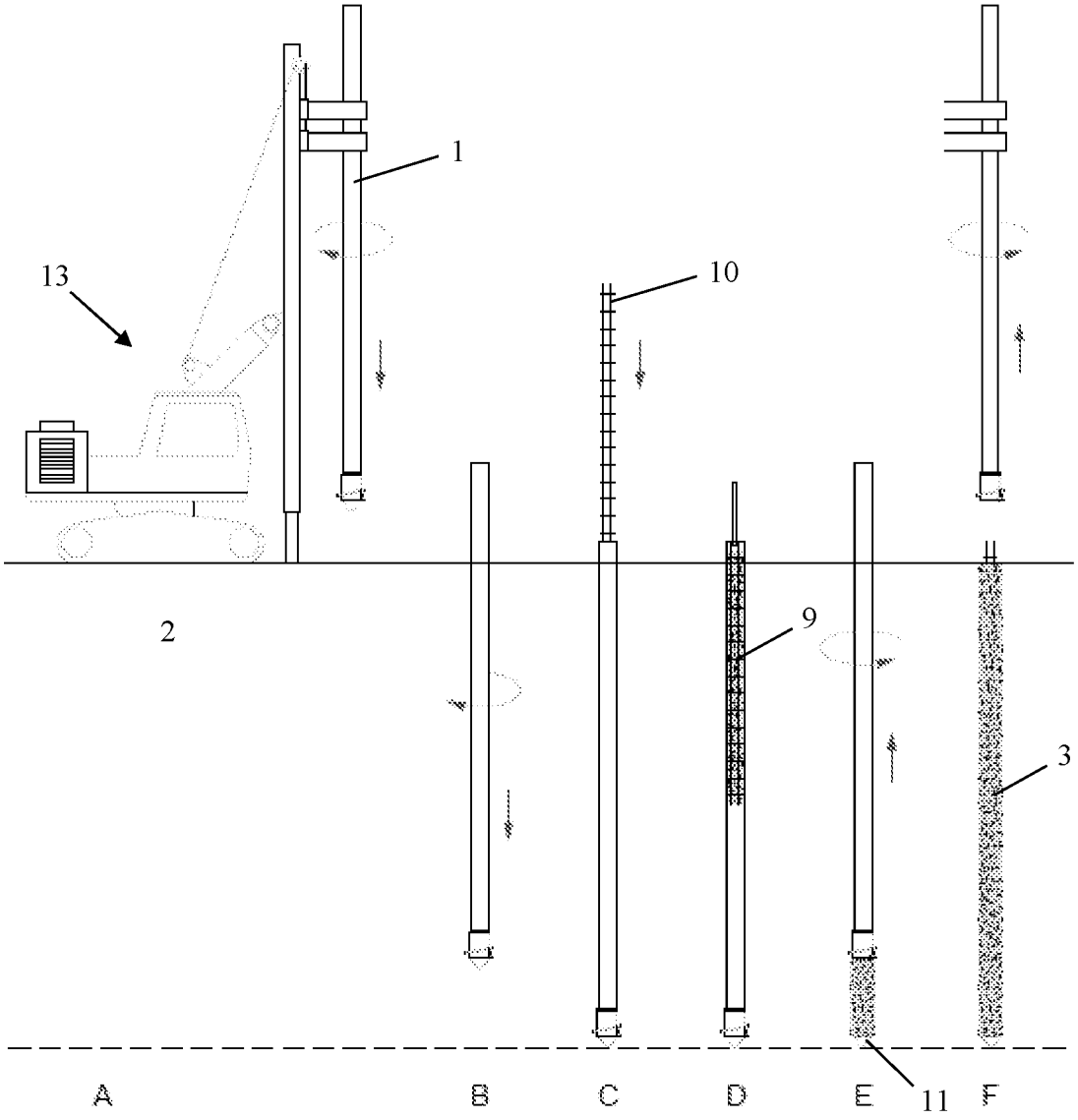
FIG. 5 shows in various stages how a foundation pile can be formed with the soil-displacement drill.
Figure 6:
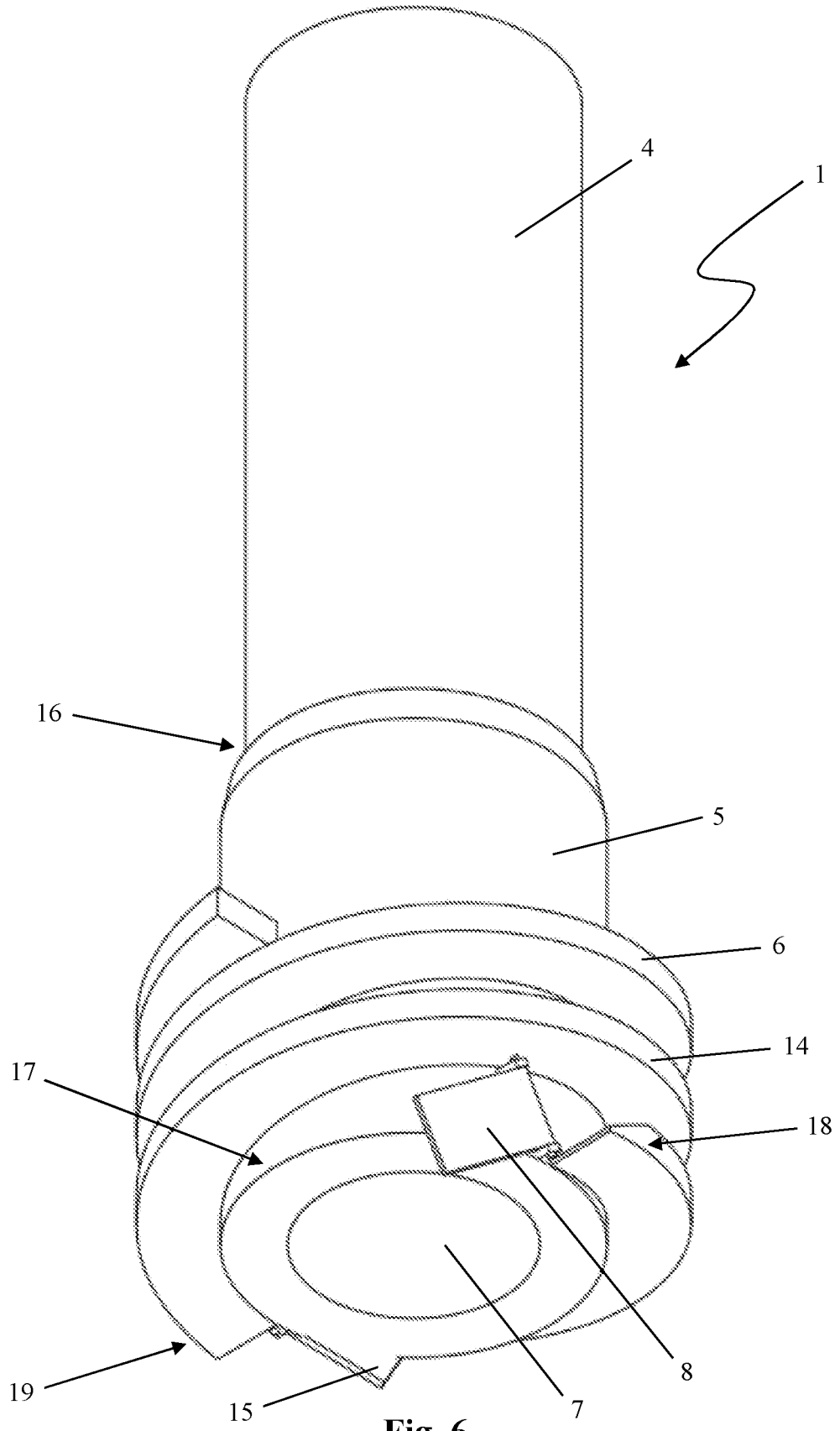
FIG. 6 shows a second embodiment of a soil-displacement drill according to at least one embodiment of this disclosure in perspective.
Figure 7:
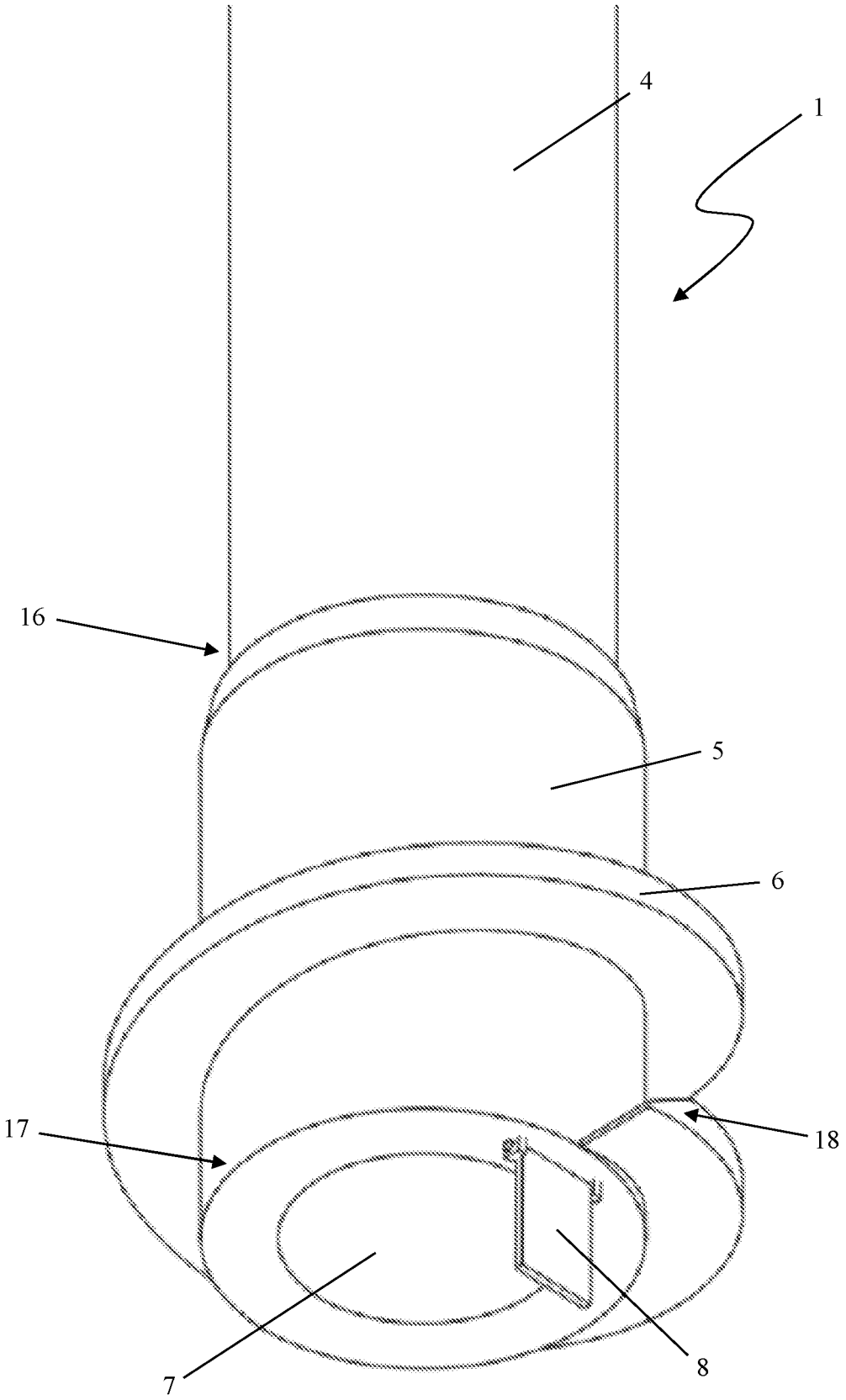
FIG. 7 shows a third embodiment of a soil-displacement drill according to at least one embodiment of this disclosure in perspective.

FIG. 5 shows in various stages how, by means of a soil-displacement drill (1) according to at least one embodiment of this disclosure, drilling can be performed in a substrate (2) in order to form a foundation pile (2).

The drill (1) is brought in the known manner by means of a crane (13) to the location at which a foundation pile (3) is to be formed. The single-use tip (11) is arranged at the bottom against the widening (5) of the drill (1) in order to close off the outlet opening (7) and form a drill tip for the drill (1) (step A).

The drill (1) is lowered and drills into the substrate (2) in the direction of the screw blade (6) (step B). During drilling into the substrate (2), the substrate (2) holds the single-use tip (11) against the widening (5). The soil is displaced sideways at the level of the widening (5). The desired drill depth is safely achieved with a soil-displacement drill (1) according to at least one embodiment of this disclosure because the screw blade (6) is at the bottom, i.e. on the widening (5).

When the drill (1) has reach the desired drill depth, a steel reinforcement (11) may be introduced into the drill pipe (step C) and the drill pipe (4) is then filled with filler material (9), such as for example concrete (step D).

The drill (1) is then unscrewed against the direction of the screw blade (6), with a speed which is slower than the speed of the screw blade (6) of this drill (1) (step E). This speed may be selected sufficiently slow to at least partially reclose the screw slot in the substrate (2) that is formed by the screw blade (6), but may remain sufficiently large to unscrew the drill pipe (4) from the substrate (2) rapidly. When the drill (1) is unscrewed, the single-use tip (11) is detached and thus remains in the bottom of the drilled hole. The filler material (9) and the reinforcement (10) are discharged through the outlet opening (7) under force of gravity so as to form the foundation pile (3) (step F)

The invention claimed is:

1. A soil-displacement drill for soil-displacing drilling into a substrate for forming a smooth bore foundation pile, comprising:

a drill pipe with a pipe casing having a first outer diameter; and a cylindrical widening configured as a displacer and having an outer casing with a second outer diameter that is greater than the first outer diameter of the drill pipe;

a screw blade for screwing the drill into the substrate; and an outlet opening for passage of material that is introduced into the drill pipe for forming the smooth bore foundation pile;

wherein the cylindrical widening is provided at a first end of the drill pipe, a first end of the cylindrical widening being remote from the drill pipe and provided with the outlet opening, wherein the screw blade protrudes relative to the outer casing of the cylindrical widening and wherein a first end of the screw blade is arranged at the first end of the cylindrical widening, wherein the drill has a flap disposed at a bottom of the cylindrical widening, the flap being movable between:

a first position in which the flap is positioned outside an imaginary extension of the screw blade beyond its first end; and a second position in which the flap is positioned such that an area of the flap which is at least as large as an area of a greatest transverse cross-section of the screw blade is positioned radially between the outlet opening and an outer edge of the screw blade, such that the flap prevents the material, when unscrewing the drill from the substrate, from entering a screw slot that is formed in the substrate by the screw blade.

2. The drill according to claim 1, wherein the flap is pivotably attached to the cylindrical widening.

3. The drill according to claim 2, wherein the flap is positioned such that, in an unhindered state when the drill is erected with the cylindrical widening below the drill pipe, the flap hangs down in the second position.

4. The drill according to claim 2, wherein the flap is positioned such that, when the drill is screwed into the substrate, the flap is held in the first position by the substrate.

5. The drill according to claim 1, wherein the screw blade has a maximum thickness between 15 mm and 100 mm.

6. The drill according to claim 1, wherein the cylindrical widening is provided with at least one second screw blade that protrudes relative to the outer casing for screwing the drill into the substrate, and has a first end of the at least one second screw blade that is arranged at the first end of the cylindrical widening and is provided with at least one second flap movable between:

a first position of the at least one second flap in which the at least one second flap is positioned (i) outside an imaginary extension of the second screw blade beyond its first end, such that the at least one second flap allows the drill to screw unhindered into the substrate; and a second position of the at least one second flap in which an area of the at least one second flap extends (i) below the cylindrical widening and (ii) adjacent an outer surface of the cylindrical widening, an inside edge of the screw blade, and the first end of the at least one second screw blade, wherein the area is at least as large as a greatest transverse cross-section of the at least one second screw blade, such that the at least one second flap prevents the material, when unscrewing the drill from the substrate, from entering a screw slot that is formed in the substrate by the at least one second screw blade.

7. A method for forming a smooth bore foundation pile in a substrate using a soil-displacement drill comprising a drill pipe and a cylindrical widening that is attached to an end of the drill pipe, comprising:

drilling the drill into the substrate, introducing material for forming the smooth bore foundation pile into the drill pipe, and withdrawing the drill from the substrate, wherein the drill is a soil-displacement drill for soil-displacing drilling into a substrate for forming a smooth bore foundation pile, the drill comprising:

a drill pipe with a pipe casing having a first outer diameter; and a cylindrical widening configured as a displacer and having an outer casing with a second outer diameter that is greater than the first outer diameter of the drill pipe;

a screw blade for screwing the drill into the substrate; and an outlet opening for passage of material that is introduced into the drill pipe for forming the smooth bore foundation pile;

wherein the cylindrical widening is provided at a first end of the drill pipe, a first end of the cylindrical widening being remote from the drill pipe and provided with the outlet opening, wherein the screw blade protrudes relative to the outer casing of the cylindrical widening and wherein a first end of the screw blade is arranged at the first end of the cylindrical widening, wherein the drill has a flap arranged at the bottom of the cylindrical widening and movable between:

a first position in which the flap is positioned outside an imaginary extension of the screw blade beyond its first end, such that the screw blade can screw unhindered into the substrate; and a second position in which the flap prevents the material, when unscrewing the drill from the substrate, from entering a screw slot that is formed in the substrate by the screw blade, wherein, during drilling of the drill into the substrate, the flap remains in the first position and, on withdrawal of the drill from the substrate, the flap remains in the second position.

8. The method according to claim 7, wherein, on withdrawal of the drill from the substrate, the drill is screwed out of the substrate with a pitch that is smaller than a pitch of the screw blade.

9. A soil-displacement drill for soil-displacing drilling into a substrate for forming a smooth bore foundation pile, comprising:

a drill pipe with a pipe casing having a first outer diameter; and a cylindrical widening configured as a displacer and having an outer casing with a second outer diameter that is greater than the first outer diameter of the drill pipe;

a screw blade for screwing the drill into the substrate; and an outlet opening for passage of material that is introduced into the drill pipe for forming the smooth bore foundation pile;

wherein the cylindrical widening is provided at a first end of the drill pipe, a first end of the cylindrical widening being remote from the drill pipe and provided with the outlet opening, wherein the screw blade protrudes relative to the outer casing of the cylindrical widening and wherein a first end of the screw blade is arranged at the first end of the cylindrical widening, wherein the drill has a flap at the bottom of the cylindrical widening movable between:

a first position in which the flap is positioned outside an imaginary extension of the screw blade beyond its first end, such that the screw blade can screw unhindered into the substrate; and a second position in which the flap prevents the material, when unscrewing the drill from the substrate, from entering a screw slot that is formed in the substrate with the screw blade.

10. A soil-displacement drill for soil-displacing drilling into a substrate for forming a smooth bore foundation pile, comprising:

a drill pipe with a pipe casing having a first outer diameter; and a cylindrical widening configured as a displacer and having an outer casing with a second outer diameter that is greater than the first outer diameter of the drill pipe;

a screw blade for screwing the drill into the substrate; and an outlet opening for passage of material that is introduced into the drill pipe for forming the smooth bore foundation pile;

wherein the cylindrical widening is provided at a first end of the drill pipe, a first end of the cylindrical widening being remote from the drill pipe and provided with the outlet opening, wherein the screw blade protrudes relative to the outer casing of the cylindrical widening and wherein a first end of the screw blade is arranged at the first end of the cylindrical widening, wherein the drill has a flap movable between:

a first position in which the flap is laying along an outer surface of the cylindrical widening without extending below it, or against an outer surface of a drill tip; and a second position in which the flap is positioned radially between the outlet opening and an outer edge of the screw blade, such that the flap prevents the material, when unscrewing the drill from the substrate, from entering a screw slot that is formed in the substrate by the screw blade.

* * * * *